US005816768A

United States Patent [19]

Yoo

[11] Patent Number: 5,816,768

[45] Date of Patent: Oct. 6, 1998

[54] REACH TYPE FORKLIFT TRUCK WITH A MAST ASSEMBLY OF REDUCED JERKING MOTION

[75] Inventor: Jae Sung Yoo, Seoul, Rep. of Korea

[73] Assignee: Daewoo Heavy Industries Ltd., Incheon, Rep. of Korea

[21] Appl. No.: 774,814

[22] Filed: Dec. 27, 1996

[30] Foreign Application Priority Data

Dec. 30, 1995 [KR] Rep. of Korea ..... 95-54734

[51] Int. Cl.[6] ..... B66F 9/10

[52] U.S. Cl. ..... 414/631; 414/544

[58] Field of Search ..... 414/628–638, 414/662–664, 544, 668

[56] References Cited

U.S. PATENT DOCUMENTS

| | | | |
|---|---|---|---|
| 3,586,183 | 6/1971 | Shaffer | 414/544 |
| 4,439,102 | 3/1984 | Allen | 414/631 X |
| 4,523,887 | 6/1985 | Reiff | 414/631 X |
| 4,690,609 | 9/1987 | Brown | 414/631 X |
| 4,690,610 | 9/1987 | Fotheringham | 414/631 |
| 5,328,321 | 7/1994 | Moffett et al. | 414/637 X |
| 5,641,261 | 6/1997 | Talbert et al. | 414/544 |

FOREIGN PATENT DOCUMENTS

| | | | |
|---|---|---|---|
| 1268258 | 6/1961 | France | 414/631 |
| 251321 | 11/1987 | Germany | 414/638 |

*Primary Examiner*—David A. Bucci
*Attorney, Agent, or Firm*—Lowe Hauptman Gopstein Gilman & Berner

[57] ABSTRACT

A reach type forklift truck is provided with a vehicle body and a reach leg extending forwards from the vehicle body. The reach leg has a guide rail fixedly attached thereto and provided with a vertical wall, a top flange and a bottom flange cooperating together to define a guide groove. A mast assembly with a base is supported on the reach leg and movable along the guide rail toward and away from the vehicle body. Front and rear support rollers are rotatably attached to the base of the mast assembly in a spaced apart relationship with each other and received in the guide groove of the guide rail. A front vertical clearance compensator is mounted to the mast base adjacent the front support roller for making contact with the underneath surface of the top flange of the guide rail, while a rear vertical clearance compensator is similarly provided adjacent the rear support roller for making contact with the top surface of the bottom flange of the guide rail. A lateral clearace compensator may be further employed to reduce the transverse jerking motion of the mast assembly.

7 Claims, 6 Drawing Sheets

REACH TYPE FORKLIFT TRUCK WITH A MAST ASSEMBLY OF REDUCED JERKING MOTION

FIELD OF THE INVENTION

The present invention relates generally to a reach type forklift truck whose mast assembly is movable back and forth along reach legs and, more specifically to an electromotive reach type forklift truck of such construction significantly reducing elevational and lateral jerking motion of a mast assembly and thus assuring stabilized handling of objects as well as quiet operation of the truck.

BACKGROUND OF THE INVENTION

Forklift trucks have been used either to lift objects of relatively heavy weight up to an elevated location or to move the objects from one place to another within a limited working site. Depending on the power sources employed, the forklift trucks are classified into an engine-driven forklift truck which may usually operate in the outdoor area and an electromotive forklift truck which are suitable for indoor operation, thanks to its reduced or little emission of exhaust gas and noise. Another method of classifying the forklift trucks depends on the mobility of mast assembly with respect to a vehicle body: a standard forklift truck whose mast assembly remains fixedly attached to the front end of the vehicle body; and a reach type forklift truck whose mast assembly is movable back and forth along reach legs with respect to the vehicle body. The standard truck is typically equipped with an internal combustion engine, while the reach type truck is provided with an electric motor and a battery feeding electricity to the motor, in which sense the latter is frequently referred to as an electromotive reach type forklift truck.

The prior art electromotive reach type truck includes a vehicle body and an overhead guard mounted on the top of the vehicle body to protect the operator from any falling objects. Extending forwards from the frontal lower edge of vehicle body are a pair of spaced-apart, parallel reach legs, each of which has a load wheel at its distal end. A drive wheel and a caster wheel are mounted to the vehicle body by way of a suspension so as to support the weight of the forklift truck on the ground in cooperation with the respective load wheel. The vehicle body is further provided with a drive unit compartment and an operator's room both arranged side to side at the rear section thereof, and with a fluid pressure control compartment and a battery storage room disposed one above the other at the front section thereof.

Welded to the respective inboard surface of the reach legs are a pair of mutually confronting rails each having a guide groove extending along the full length of the corresponding reach leg. A mast assembly, which serves to lift objects, is mounted between the rails for back and forth sliding movement, viz, reach operation, relative to the vehicle body. The reach operation of the mast assembly may be effected through the use of a reach cylinder, one end of which is secured to the vehicle body and the other end of which is affixed to the mast assembly.

Examples of the conventional mast assembly include a two stage mast assembly and a three stage mast assembly that can lift objects up to a higher elevation than the two stage mast assembly would do. The two stage mast assembly consists of an outer mast, an inner mast telescopically fitted to the outer mast for elevational movement therealong and a carriage assembly slidable along the inner mast together with the objects loaded thereon. The elevational movement of the inner mast may be brought about by means of a lift cylinder. The inner mast carries a couple of sheaves rotatably attached to the top portion thereof. Trained over or wound around the respective sheave is a chain anchored at one end to the inner mast and secured at the other end to the carriage assembly such that the elevational movement of the inner mast may cause the carriage assembly to slide along the inner mast.

On the contrary, the three stage mast assembly includes an outer mast, an intermediate mast telescopically fitted to the outer mast for elevational movement therealong, an inner mast similarly fitted to the intermediate mast for elevational movement therealong and a carriage assembly slidable along the inner mast together with the objects to be lifted. A lift cylinder is used to cause elevational movement of the intermediate mast relative to the outer mast. The intermediate mast carries at its top portion a couple of sheaves around which chains are wound with their rear ends anchored to the outer mast and their front end secured to the bottom of the inner mast. This will make sure that the elevational movement of the intermediate mast results in the like movement of the inner mast along the intermediate mast. The sliding movement of the carriage assembly along the inner mast may be provoked by a carriage cylinder fixedly mounted to the inner mast.

According to the prior art forklift trucks as referred to above, need exists to make the mast assembly move forwards and rearwards smoothly along the reach legs without causing undue friction. For this purpose, the mast assembly includes a mast base positioned between the guide rails and a pair of support rollers attached to the respective flank side of the mast base. Each of the guide rails has a longitudinally extending guide groove adapted to receive the support rollers of the mast assembly. The guide groove is defined by a vertical wall welded to the respective reach leg and top and bottom flanges projecting inboard from the upper and lower edges of the vertical wall. As the mast assembly moves back and forth by virtue of the reach cylinder, the support rollers would make a rolling contact with the top and bottom flanges of the guide rail.

It will be a matter of course that certain level of clearance exists between the support rollers and the flanges of the guide rail, however precisely fabricated they may be. Such clearance tends to grow larger as the forklift truck is put in service for a prolonged period of time. Due to the existence of the increased clearance, the mast assembly may be subject to undesirable jerking motion in vertical and lateral directions when it moves along the guide rail or when the truck incorporating the mast assembly travels on an uneven ground. The jerking motion of the mast assembly would reduce stability of objects placed thereon, making it difficult for the operator to perform the task of lifting or moving the objects. Moreover, the jerking motion may sometimes result in premature failure of the associated truck parts and may produce severe noise.

SUMMARY OF THE INVENTION

Accordingly, it is an object of the invention to provide a reach type forklift truck that can reduce the vertical and/or lateral jerking motion of a mast assembly that might otherwise occur during sliding movement of the mast assembly along a guide rail and during the travelling operation of the truck.

In accordance with the invention, a reach type forklift truck is provided with a vehicle body and a reach leg extending forwards from the vehicle body. The reach leg has a guide rail fixedly attached thereto and provided with a vertical wall, a top flange and a bottom flange cooperating together to define a guide groove. A mast assembly with a base is supported on the reach leg and movable along the guide rail toward and away from the vehicle body. Front and rear support rollers are rotatably attached to the base of the mast assembly in a spaced apart relationship with each other and received in the guide groove of the guide rail. A front vertical clearance compensator is mounted to the mast base adjacent the front support roller for making contact with the underneath surface of the top flange of the guide rail, while a rear vertical clearance compensator is similarly provided adjacent the rear support roller for making contact with the top surface of the bottom flange of the guide rail. A lateral clearace compensator may be further employed to reduce the transverse jerking motion of the mast assembly.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
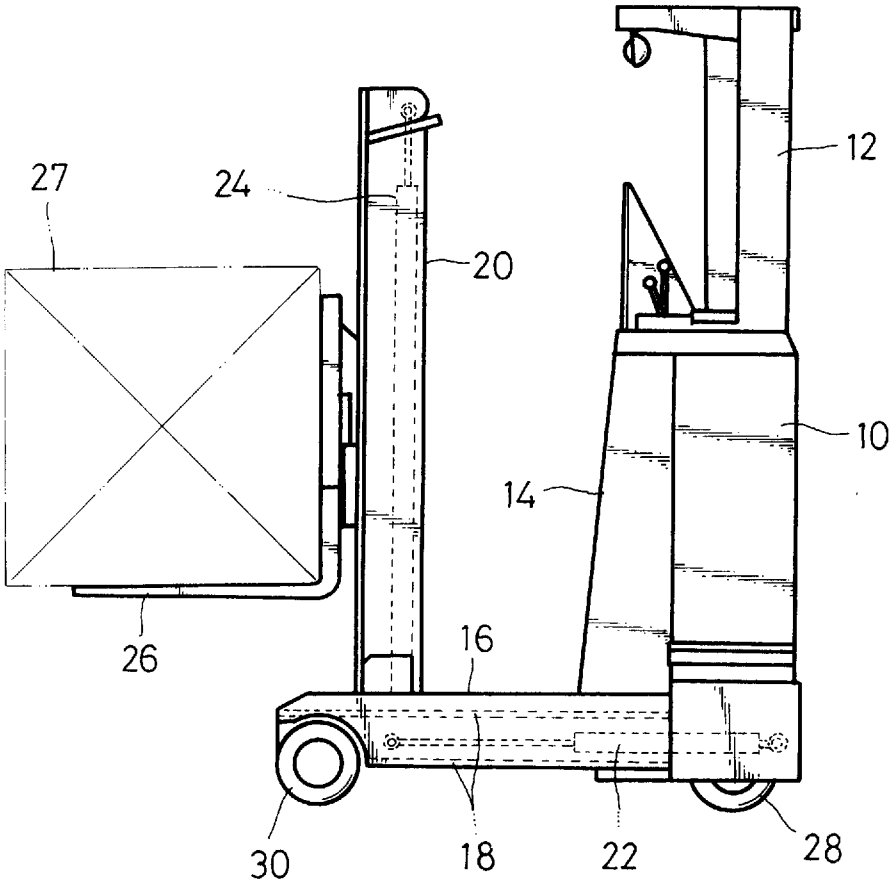
FIG. 1 is a side elevational view of a reach type forklift truck to which the instant invention is applied.

Referring now to FIG. 1, it will be noted that a forklift truck is provided with a vehicle body 10 and an overhead guard 12 mounted on the top of the vehicle body 10 to protect the operator from any falling objects. The vehicle body 10 has a battery storage room 14 that may removably receive a battery feeding electric energy to various electric devices of the forklift truck, inclusive of an electric drive motor not shown in the drawings. Extending forwards from the frontal lower edge of the vehicle body are a pair of parallel reach legs 16 and a pair of guide rails 18 each welded to the inboard side of the respective reach leg 16.

A mast assembly 20 is supported on the respective guide rail 18 for back and forth sliding movement with respect to the vehicle body 10 in response to the extension and retraction of a reach cylinder 22. The mast assembly 20 is provided with forks 26 supporting an object 27 to be lifted and elevationally movable along the mast assembly 20 by virtue of a lift cylinder 24. A drive wheel 28 is mounted to the vehicle body 10 through the use of a suspension (not shown), while a load wheel 30 is rotatably attached to the front distal end of the respective reach leg 16.

Figure 2:
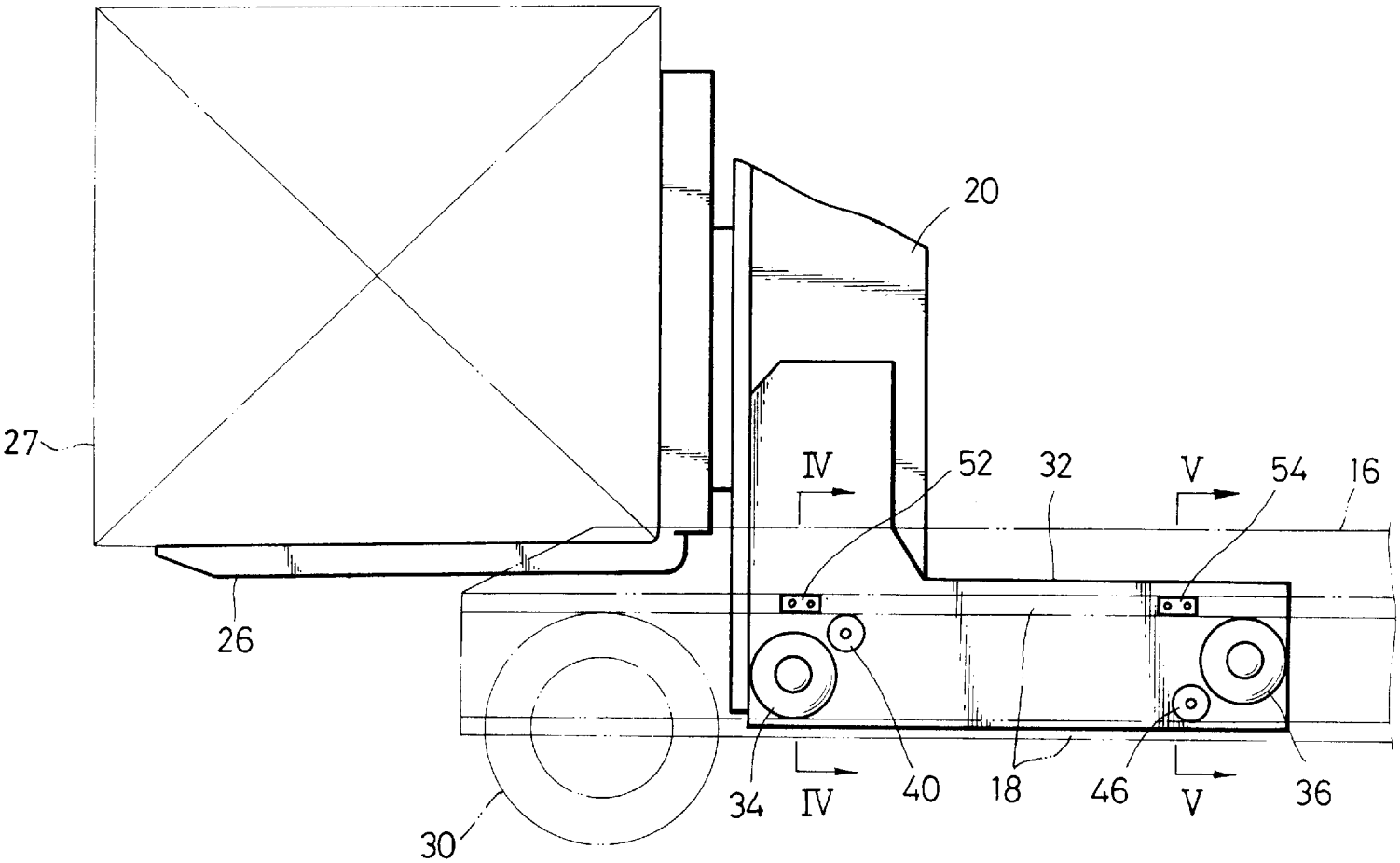
FIG. 2 shows the lower section of a mast assembly in a forklift truck according to the first embodiment of the invention, with a reach leg and an object indicated in double-dotted phantom lines.
Figure 3:
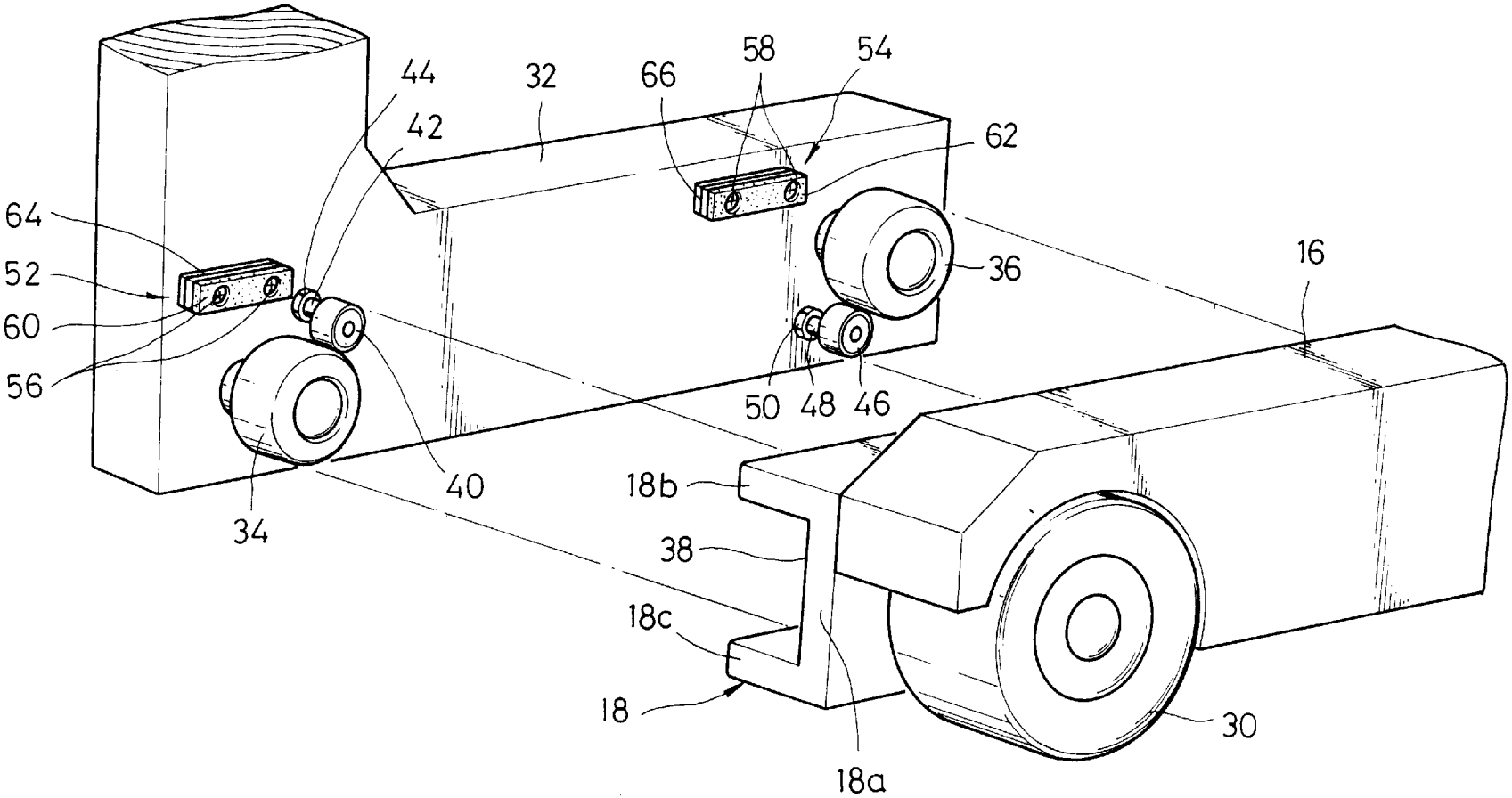
FIG. 3 is a partially cut-away perspective view showing the base of the mast assembly and the reach leg on an enlarged scale.

Turning to FIGS. 2 and 3, there is shown the lower section of the mast assembly 20 in a forklift truck in accordance with the first embodiment of the invention. As clearly shown in this view, the mast assembly 20 includes a mast base 32 extending substantially in parallel with the reach leg 16 and the guide rail 18 and front and rear support rollers 34, 36 rotatably attached to the mast base 32 in a mutually spaced-apart relationship therealong. The front and rear support rollers 34, 36 assures smooth sliding movement of the mast assembly 20 along the guide rail 18 as the reach cylinder 22 retracts or extends.

Figure 5:
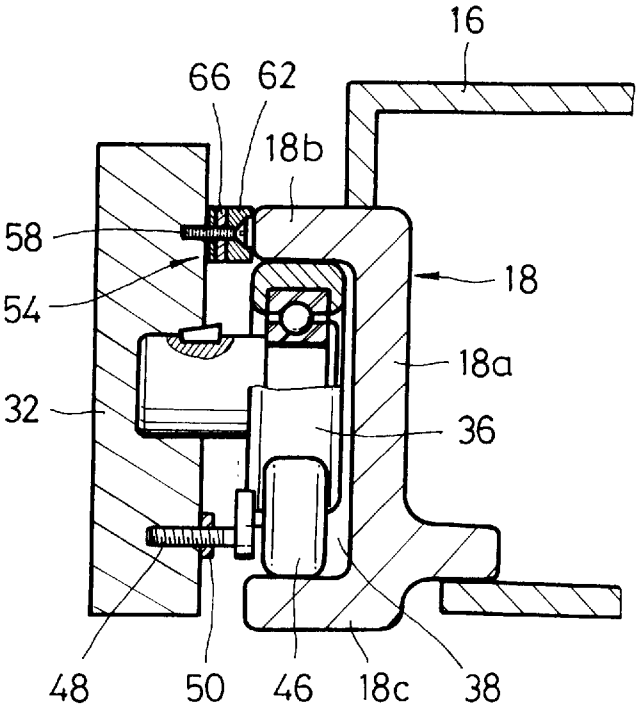
FIG. 5 is a sectional view taken along line V—V in FIG. 2, best showing a rear support roller and a rear pinch roller received the guide groove of the guide rail.
Figure 4:
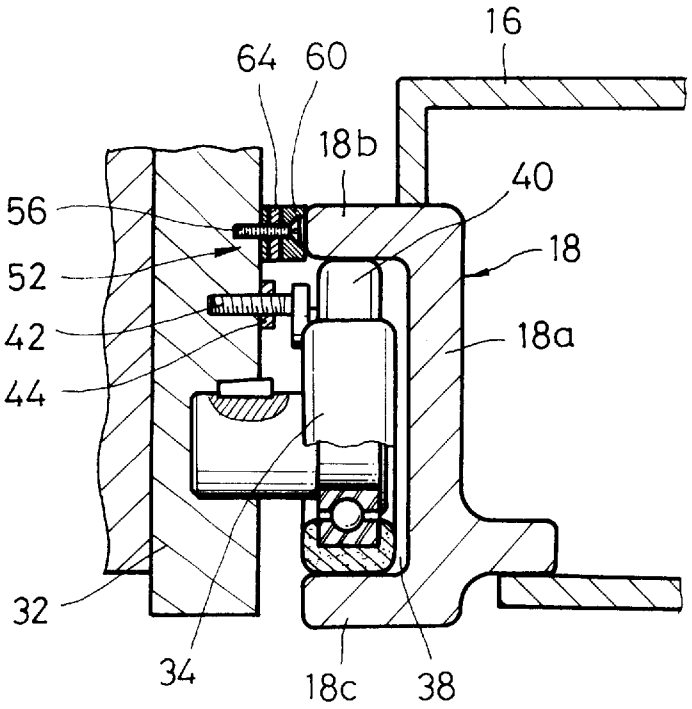
FIG. 4 is a sectional view taken along line IV—IV in FIG. 2, best showing a front support roller and a front pinch roller received in the guide groove of a guide rail.

The guide rails 18 has a longitudinal guide groove 38 open inboards to receive the front and rear support rollers 34, 36. The guide groove 38 is defined by a vertical wall 18*a*, a top flange 18*b* and a bottom flange 18*c* of the guide rail 18. The top flange 18*b* has an underneath surface facing the bottom flange 18*c* and an inboard end surface facing the base 32 of the mast assembly 20, whereas the bottom flange 18*c* is provided with a top surface facing the top flange 18*b* and an inboard end surface facing the base 32 of the mast assembly 20. When the object 27 is placed on the fork 26 of the mast assembly 20, the front support roller 34 would make a rolling contact with and is pressed against the top surface of the bottom flange 18*c* as best illustrated in FIG. 4, with some vertical clearance left between the front support roller 34 and the top flange 18*b*, to thereby bear the weight of the mast assembly 20 and the object 27 to be lifted. On the contrary, the rear support roller 36 would make a rolling contact with and is pressed against the underneath surface of the top flange 18*b* as illustrated in FIG. 5, with some vertical clearance left between the rear support roller 36 and the bottom flange 18*c*, to thus prevent the mast assembly 20 from falling forwards.

Referring again to FIGS. 2 and 3, it will be seen that a front pinch roller 40 is rotatably attached to the base 32 of the mast assembly 20 at a location behind and above the front support roller 34. The front pinch roller 40 will make a rolling contact with the underneath surface of the top flange 18*b* of the guide rail 18 to compensate the vertical clearance between the front support roller 34 and the top flange 18*b*, thus reducing or substantially eliminating the tendency of the mast assembly 20 to be jerked upwards at its front end during operation of the forklift truck. To effectively suppress the upward jerking motion of the front end of the mast assembly 20, it will be preferred that the front pinch roller 40 should be positioned at 1:30 position of a clock with respect to the front support roller 34.

The front pinch roller 40 is attached to the base 32 of the mast assembly 20 by means of an eccentric shaft 42 which remains offset from the axis of rotation of the front pinch roller 40, as readily appreciated in FIG. 4. The eccentric shaft 42 has a length of external thread, at its proximal end, with which a lock nut 44 is threadedly engaged to keep the eccentric shaft 42 in place. The position of the front pinch roller 40 relative to the top flange 18*b* of the guide rail 18 may be changed by way of untightening the lock nut 44, swinging the front pinch roller 40 about the eccentric shaft 42 toward or away from the underneath surface of the top flange 18*b* and then tightening the lock nut 44.

Similar to the front pinch roller 40 as set forth just above, a rear pinch roller 46 is rotatably attached to the base 32 of the mast assembly 20 at a location in front of and below the rear support roller 36. The rear pinch roller 46 will make a rolling contact with the top surface of the bottom flange 18*c* of the guide rail 18 to compensate the vertical clearance between the rear support roller 36 and the bottom flange 18*c*, thus reducing or substantially eliminating the tendency of the mast assembly 20 to be jerked downwards at its rear end during operation of the forklift truck. With a view to effectively suppress the downward jerking motion of the rear end of the mast assembly, it will be desirable that the rear pinch roller 46 should be positioned at 7:30 position of a clock with respect to the rear support roller 36.

The rear pinch roller 46 is attached to the base 32 of the mast assembly 20 by means of an eccentric shaft 48 which remains offset from the axis of rotation of the rear pinch roller 46 as can be seen in FIG. 5. The eccentric shaft 48 has a length of external thread, at its proximal end, with which a lock nut 50 is threadedly engaged to keep the eccentric shaft 48 in place. The position of the rear pinch roller 46 relative to the bottom flange 18*c* of the guide rail 18 may be changed by way of untightening the lock nut 50, swinging the rear pinch roller 46 about the eccentric shaft 48 toward or away from the top surface of the bottom flange 18*c* and tightening the lock nut 48 again.

Adjacent to and above the front and rear support rollers 34, 36, front and rear pad blocks 52, 54 are mounted to the base 32 of the mast assembly 20 by means of set screws 56, 58. The pad blocks 52, 54 are in alignment with and makes sliding contact with the inboard end surface of the top flange 18*b* of the guide rail 18, thereby compensating the lateral clearance between the mast base 32 and the inboard end surface of the top flange 18*b*. The role that the front and rear pad blocks 52, 54 will play is to reduce the tendency of the mast assembly 20 to be jerked in the transverse direction during the operation of the forklift truck. Each of the front and rear pad blocks 52, 54 is provided with a vertical pad 60, 62 directly contacting the top flange 18*b* and at least one shim 64, 66 enabling the vertical pad 60, 62 to be thickness-adjustable.

Figure 6:
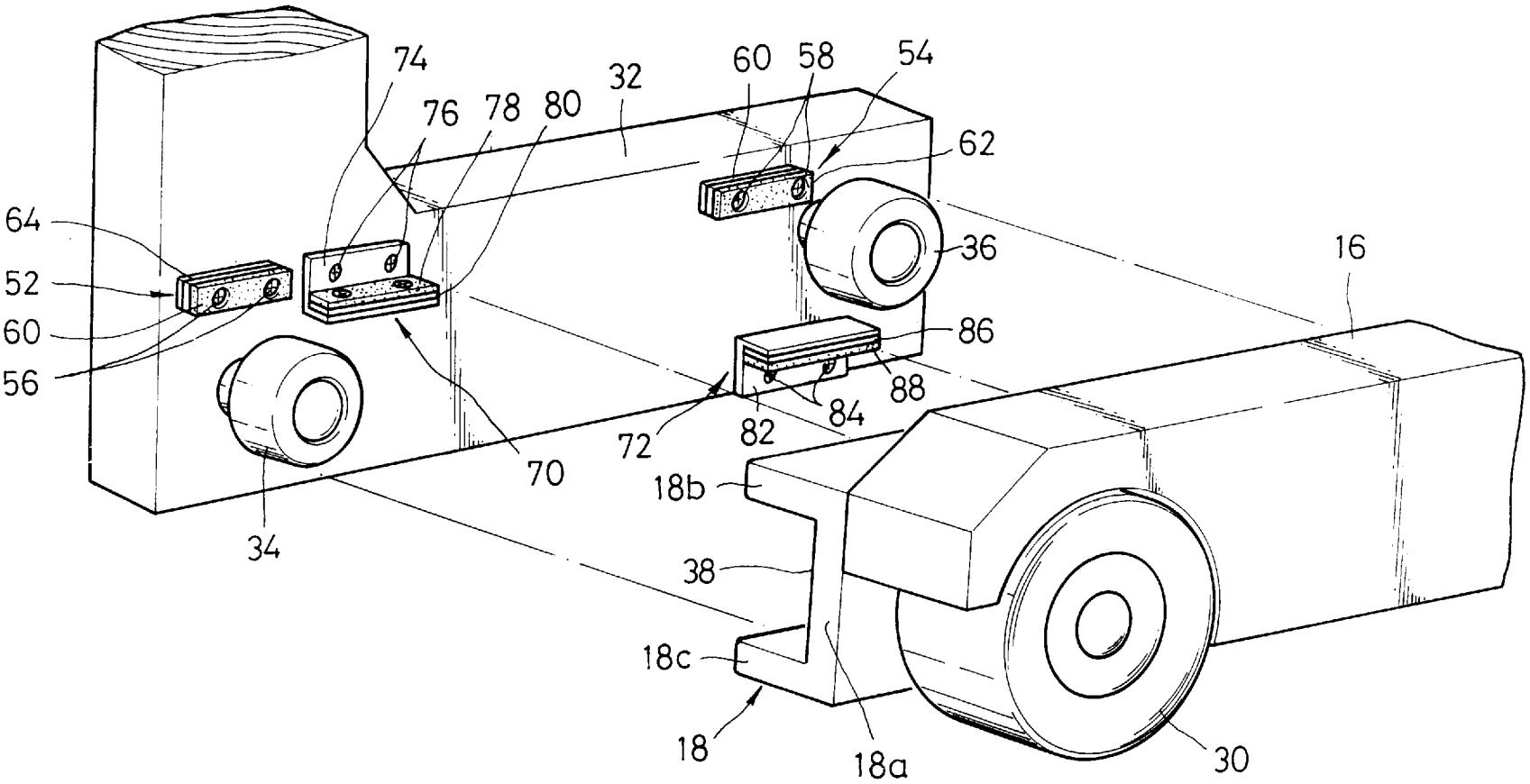
FIG. 6 is a partially cut-away perspective view illustrating the base of the mast assembly and the reach leg in a forklift truck according to the second embodiment of the invention.

FIG. 6 shows the mast base 32 employed in a forklift truck in accordance with the second embodiment of the invention. The second embodiment differs from the first embodiment noted above in that front and rear pinch blocks 70, 72 are used in place of the front and rear pinch rollers 40, 46 shown in FIGS. 2 through 5. This would justify attaching the same reference numerals to the same parts as those of the first embodiment and omitting description thereof. The front pinch block 70 is positioned at 1:30 position of a clock with respect to the front support roller 34 and is provided with a generally "L"-shaped mounting bracket 74 fixedly secured to the mast base 32 by set screws 76 and a top horizontal pad 78 thickness-adjustably affixed to the mounting bracket 74 with at least one shim 80 interposed between the mounting bracket 74 and the top pad 78. The top pad 78 will make a sliding contact with the underneath surface of the top flange 18*b* of the guide rail 18, thus reducing or substantially eliminating the tendency of the mast assembly 20 to be jerked upwards at its front end during operation of the forklift truck.

Similarly, the rear pinch block 72 is positioned at 7:30 position of a clock with respect to the rear support roller 36 and is provided with a generally "L"-shaped mounting bracket 82 fixedly secured to the mast base 32 by set screws 84 and a bottom horizontal pad 88 thickness-adjustably affixed to the mounting bracket 82 with at least one shim 86 interposed between the mounting bracket 82 and the bottom pad 88. The bottom pad 88 will make a sliding contact with the top surface of the bottom flange 18*c* of the guide rail 18, reducing or substantially eliminating the tendency of the mast assembly 20 to be jerked downwards at its rear end during operation of the forklift truck.

Figure 7:
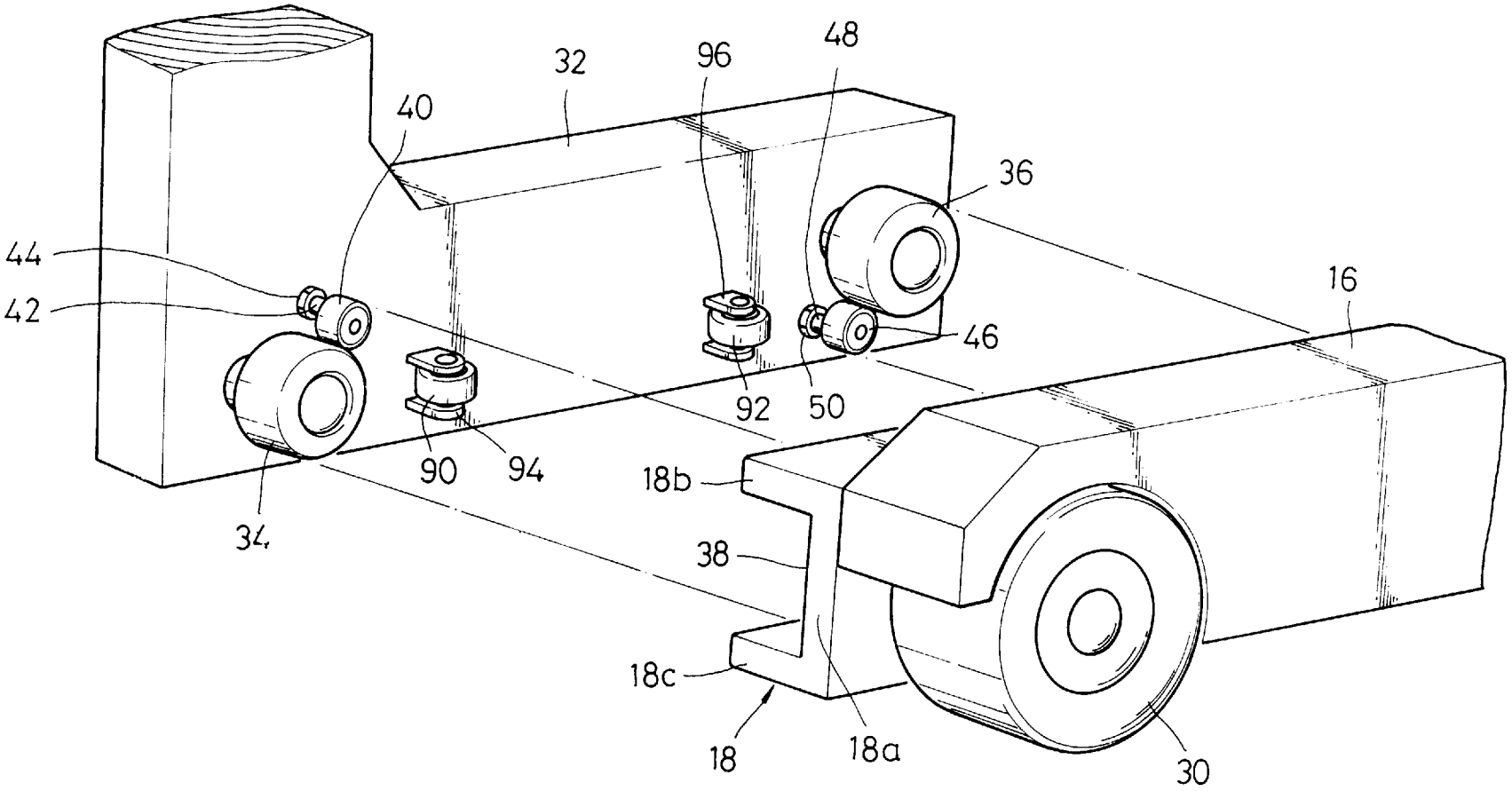
FIG. 7 is a partially cut-away perspective view representing the base of the mast assembly and the reach leg in a forklift truck according to the third embodiment of the invention.

Referring finally to FIG. 7, there is illustrated the mast base employed in a forklift truck in accordance with the third embodiment of the invention. The third embodiment is distinguished from the first embodiment in that front and rear side rollers 90, 92 are used to suppress transverse jerking motion of the mast assembly 20 in place of the front and rear pad blocks 52, 54 shown in FIGS. 2 through 5. This would justify attaching the same reference numerals to the same parts as those of the first embodiment and omitting description thereof. The front and rear side rollers 90, 92 are mounted to the mast base 32 by use of brackets 94, 96 respectively for rotation about vertical axes and will make a rolling contact with the vertical wall 18*a* of the guide rail 18 to reduce the tendency of the mast assembly 20 to be jerked in the transverse direction.

While the invention has been shown and described with reference to a preferred embodiment, it should be apparent to one of ordinary skill in the art that many changes and modifications may be made without departing from the spirit and scope of the invention as defined in the claims.

What is claimed is:

1. A reach type forklift truck for lifting or moving objects from one place to another, comprising:

a vehicle body;

a reach leg extending forwards from the vehicle body and having a guide rail fixedly attached thereto, said guide rail including a vertical wall, a top flange and a bottom flange cooperating together to define a guide groove;

a mast assembly having a base movable along the reach leg toward and away from the vehicle body;

front and rear support rollers rotatably attached to the base of the mast assembly in a spaced-apart relationship from each other and received in the guide groove of the guide rail;

a front pinch roller rotatably attached to the base of the mast assembly for swinging movement toward and away from the top flange of the guide rail; and a rear pinch roller rotatably attached to the base of the mast assembly for swinging movement toward and away from the bottom flange of the guide rail.

2. The reach type forklift truck as recited in claim 1, wherein the front pinch roller is located behind and above the front support roller and wherein the rear pinch roller is positioned in front of and below the rear support roller.

3. The reach type forklift truck as recited in claim 1, further comprising lateral clearance compensator means mounted to the base of the mast assembly for reducing the tendency of the mast assembly to be jerked in a transverse direction of the truck.

4. The reach type forklift truck as recited in claim 3, wherein the lateral clearance compensator means comprises front and rear vertical pads affixed to the base of the mast assembly in alignment with the top flange of the guide rail.

5. The reach type forklift truck as recited in claim 4, wherein the front and rear vertical pads are thickness-adjustably attached to the base of the mast assembly.

6. The reach type forklift truck as recited in claim 1, wherein said front pinch roller, when swung toward the top flange, makes a close sliding contact with an under surface of the top flange to thereby eliminate the tendency of the mast assembly to be jerked upwards at its front end during operation of the forklift truck.

7. The reach type forklift truck as recited in claim 1, wherein said rear pinch roller is swingable toward and away from the bottom flange of the guide rail so that as the rear pinch roller is swung toward the bottom flange, the rear pinch roller effects close sliding contact with a top surface of the bottom flange to thereby prevent the mast assembly from being jerked downwards at its rear end.

* * * * *